US005781996A

United States Patent [19]

Spencer

[11] Patent Number: 5,781,996

[45] Date of Patent: Jul. 21, 1998

[54] METHOD OF MANUFACTURING HEAT TRANSFER TUBE

[75] Inventor: Steven J. Spencer, Liverpool, N.Y.

[73] Assignee: Carrier Corporation, Syracuse, N.Y.

[21] Appl. No.: 829,294

[22] Filed: Mar. 31, 1997

Related U.S. Application Data

[60] Division of Ser. No. 639,568, Apr. 29, 1996, Pat. No. 5,669,441, which is a continuation-in-part of Ser. No. 341, 235, Nov. 17, 1994, abandoned.

[51] Int. Cl.[6] ..... B23P 15/26

[52] U.S. Cl. ..... 29/890.048; 29/727

[58] Field of Search ..... 29/890.048, 727; 165/181, 184, 133, 179

[56] References Cited

U.S. PATENT DOCUMENTS

| | | | |
|---|---|---|---|
| 4,577,381 | 3/1986 | Sato et al. | 29/890.048 |
| 4,660,630 | 4/1987 | Cunningham et al. | 29/890.048 |

*Primary Examiner*—Irene Cuda

[57] ABSTRACT

An evaporator heat transfer tube (10) for use in a heat exchanger where heat is transferred between a fluid flowing through the tube and a fluid flowing around the exterior of the tube and where the fluid external to the tube boils during the heat exchange process. The tube has a plurality of helical fins (20) extending around its external surface (13). A pattern of notches (30) extends at an oblique angle ($\alpha$) across the fins at intervals about the circumference of the tube. A spike (22) having a flattened distal tip (23) is formed between each pair of adjacent notches. The maximum width ($W_t$) of the spike at its tip is greater than the width ($W_s$) of the base portion of the fin and is of a width sufficient to overlap with and contact the distal tips of spikes in adjacent fins on both sides thereof, thus forming reentrant cavities between the adjacent fins and under the overlapping tips. The fins, notches and spikes are formed in the tube by rolling the wall of the tube between a mandrel and, first, a gang of finning disks (63), then, second, a notching wheel (66) and, third, a smooth wheel (67) to flatten the spikes and create the overlapping of spike tips.

1 Claim, 4 Drawing Sheets

METHOD OF MANUFACTURING HEAT TRANSFER TUBE

This application is a division of application Ser. No. 08/639,568, filed Apr. 29, 1996, now U.S. Pat. No. 5,669,441, which is a CIP of Ser. No. 08/341,235, filed Nov. 17, 199 , abandoned.

BACKGROUND OF THE INVENTION

The present invention relates generally to heat transfer tubes. In particular, the invention relates to the external surface configuration of a heat exchanger tube that is used for evaporation of a liquid in which the tube is submerged.

Many types of air conditioning and refrigeration systems contain shell and tube type evaporators. A shell and tube evaporator is a heat exchanger in which a plurality of tubes are contained within a single shell. The tubes are customarily arranged to provide a multiplicity of parallel flow paths through the heat exchanger for a fluid to be cooled. The tube are immersed in a refrigerant that flows through the heat exchanger shell. The fluid is cooled by heat transfer through the walls of the tubes. The transferred heat vaporizes the refrigerant in contact with the exterior surface of the tubes. The heat transfer capability of such an evaporator is largely determined by the heat transfer characteristics of the individual tubes. The external configuration of an individual tube is important in establishing its overall heat transfer characteristics.

There are several generally known methods of improving the heat transfer performance of a heat transfer tube. Among these are (1) increasing the heat transfer area of the tube surface and (2) promoting nucleate boiling on the surface of the tube that is in contact with the boiling fluid. In the nucleate boiling process, heat transferred from the heated surface vaporizes liquid in contact with the surface and the vapor forms into bubbles. Heat from the surface superheats the vapor in a bubble and the bubble grows in size. When the bubble size is sufficient, surface tension is overcome and the bubble breaks free of the surface. As the bubble leaves the surface, liquid enters the volume vacated by the bubble and vapor remaining in the volume has a source of additional liquid to vaporize to form another bubble. The continual forming of bubbles at the surface, the release of the bubbles from the surface and the rewetting of the surface together with the convective effect of the vapor bubbles rising through and mixing the liquid result in an improved heat transfer rate for the heat transfer surface.

It is also well known that the nucleate boiling process can be enhanced by configuring the heat transfer surface so that it has nucleation sites that provide locations for the entrapment of vapor and promote the formation of vapor bubbles. Simply roughening a heat transfer surface, for example, will provide nucleation sites that can improve the heat transfer characteristics of the surface over a similar smooth surface.

In boiling liquid refrigerants, for example in the evaporator of an air conditioning or refrigeration system, nucleation sites of the re-entrant type produce stable bubble columns and good surface heat transfer characteristics. A reentrant type nucleation site is a surface cavity in which the opening of the cavity is smaller than the subsurface volume of the cavity. An excessive influx of the surrounding liquid can flood a re-entrant type nucleation site and deactivate it. By configuring the heat transfer surface so that it has relatively larger communicating subsurface channels with relatively smaller openings to the surface, flooding of the vapor entrapment or nucleation sites can be reduced or prevented and the heat transfer performance of the surface improved.

SUMMARY OF THE INVENTION

The present invention is a heat transfer tube having one or more fin convolutions formed on its external surface. Notches extend at an oblique angle across the fin convolutions at intervals about the circumference of the tube. There is a fin spike between each adjacent pair of notches in a fin convolution. The distal tip of the a fin spike is flattened and wider than the fin root. The width of the tip is such that there is overlap between the tips of fin spikes in adjacent fin convolutions thus forming reentrant cavities between the fin convolutions.

The notches in the fin further increase the outer surface area of the tube as compared to a conventional finned tube. In addition, the configuration of the flattened fin spikes and the cavities formed by them promote nucleate boiling on the outer surface of the tube.

Manufacture of a notched fin tube can be easily and economically be accomplished by adding an additional notching disk to the tool gang of a finning machine of the type that forms fins on the outer surface of a tube by rolling the tube wall between an internal mandrel and external finning disks.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
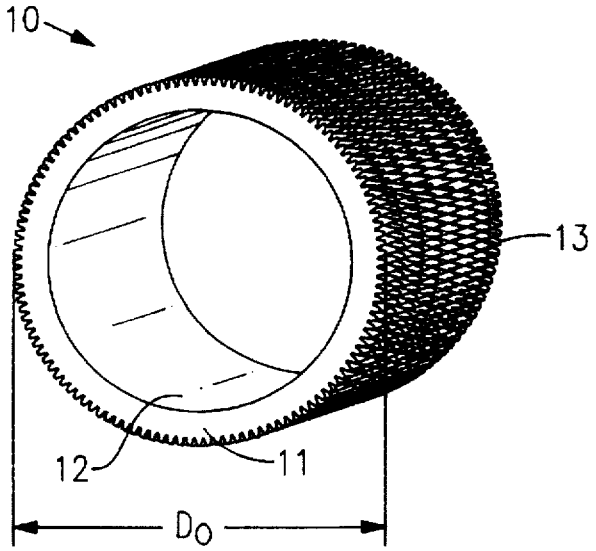
FIG. 1 is a pictorial view of the tube of the present invention.

Referring to FIG. 1, tube 10 comprises tube wall 11, tube inner surface 12 and tube outer surface 13. Extending from the outer surface of tube wall 11, are circumferentially extending helical fins which have been notched and compressed to form a pattern of cavities, channels and grooves, as more fully described below. Tube 10 has outer diameter $D_o$ including the height of the fins.

The tube of the present invention may be readily manufactured by a rolling process.

Figure 2:
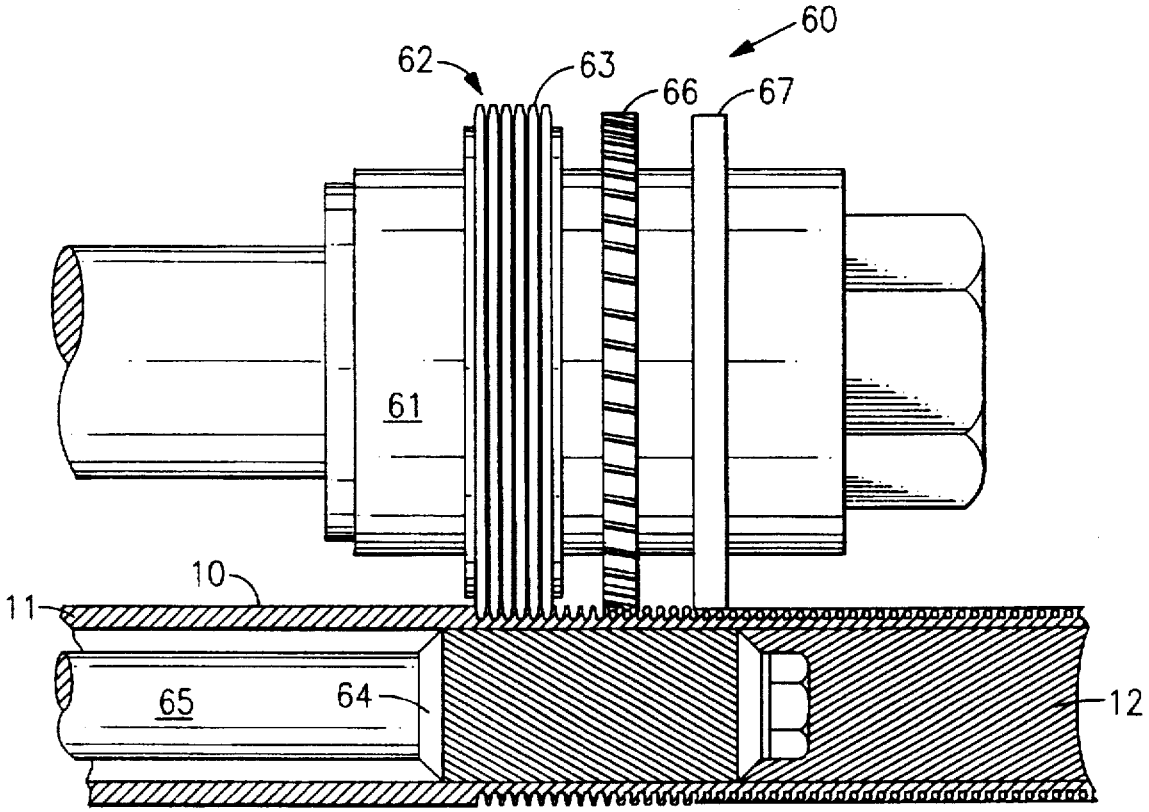
FIG. 2 is a view illustrating how the tube of the present invention is manufactured.

FIG. 2 illustrates such a process. In FIG. 2, finning machine 60 is operating on tube 10, made of a malleable metal such as copper, to produce both interior ribs and exterior fins on the tube. Finning machine 60 has one or more tool arbors 61, each containing tool gang 62, comprised of a number of finning disks 63, notching wheel 66 and smooth wheel 67. Extending into the tube is mandrel shaft 65 to which is attached mandrel 64.

Wall 11 is pressed between mandrel 64 and finning disks 63 as tube 10 rotates. Under pressure, metal flows into the grooves between the finning disks and forms a ridge or fin on the exterior surface of the tube. The fins define circumferential grooves 40 therebetween (FIG. 2). As it rotates, tube 10 advances between mandrel 64 and tool gang 62 (from left to right in FIG. 2) resulting in a number of helical fin convolutions being formed on the tube, the number being a function of the number of tool arbors 61 in use on finning machine 60. In the same pass and after tool gang 62 forms fins on tube 10, notching wheel 66 impresses oblique notches into the fins. Smooth wheel 67 then flattens and spreads the distal tips of the fins.

Mandrel 64 may be configured in such a way, as shown in FIG. 2, that it will impress some type of pattern into the internal surface of the wall of the tube passing over it. A typical pattern is of one or more helical rib convolutions. Such a pattern can improve the efficiency of the heat transfer between the fluid flowing through the tube and the tube wall. The internal surface configuration is not, however, a part of the present invention.

Figure 3:
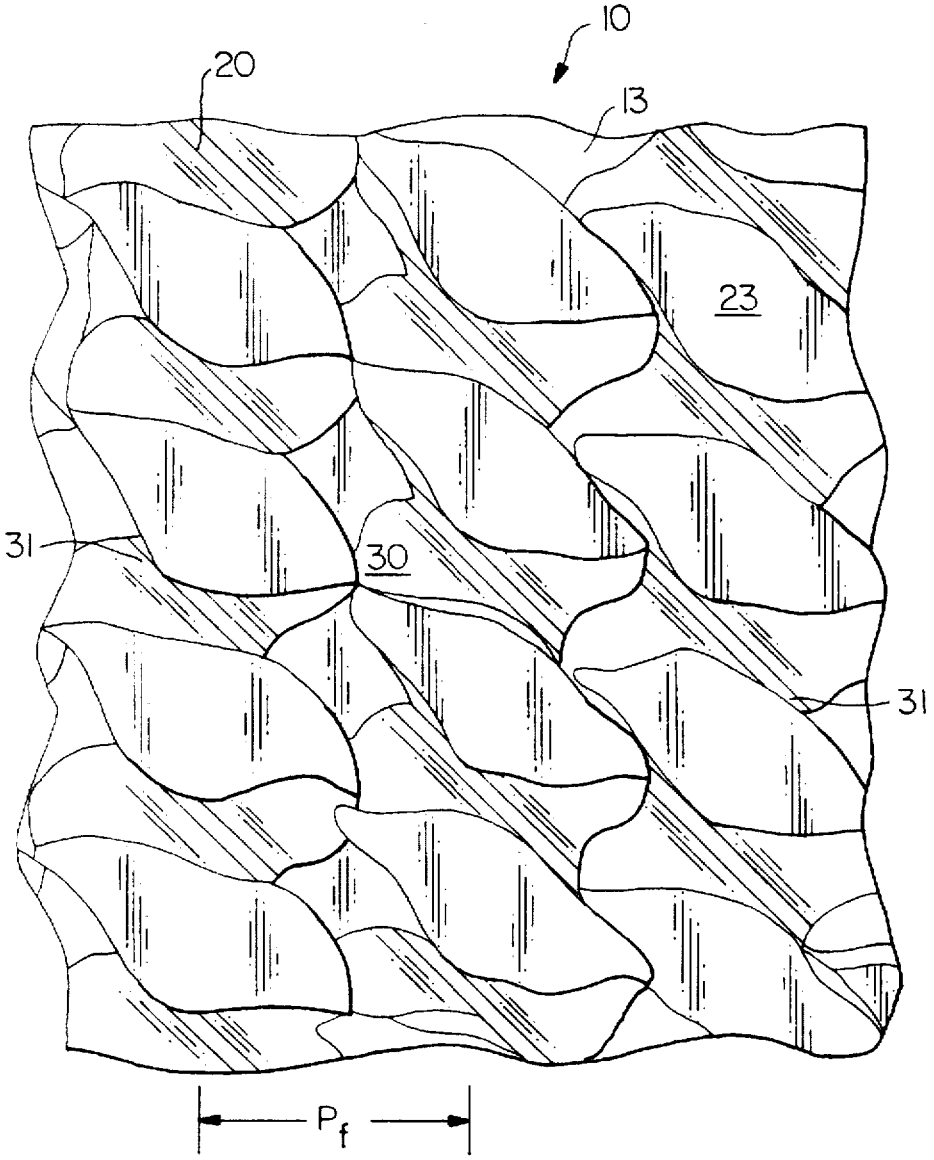
FIG. 3 is a highly magnified plan view of a portion of the external surface of the tube of the present invention.

FIG. 3 shows, in plan view, a portion of the external surface of the tube greatly magnified. Extending circumferentially (vertically on the page in the plan view of FIG. 3) around the outer surface 13 of tube 10 are a number of helical fins convolutions 20 which were formed by the finning disks 63. Extending obliquely across the axial span of each fin convolution at intervals are a pattern of notches 30 formed by the wheel 66 (FIG. 2). The base of each notch 30 is designated by the numeral 31. Formed between each pair of adjacent notches in a given fin convolution is a fin spike 22 having a base portion 21 (FIG. 5) and a distal tip 23 which has been flattened or compressed by the smooth wheel 67 (FIG. 2). A line L connecting the extreme points of the tip 23 and which defines the widest portion of the tip is hereinafter referred to as the tip axis L. The fin pitch or unit of axial tube length divided by the number of fins in that length is $P_f$.

Figure 4:
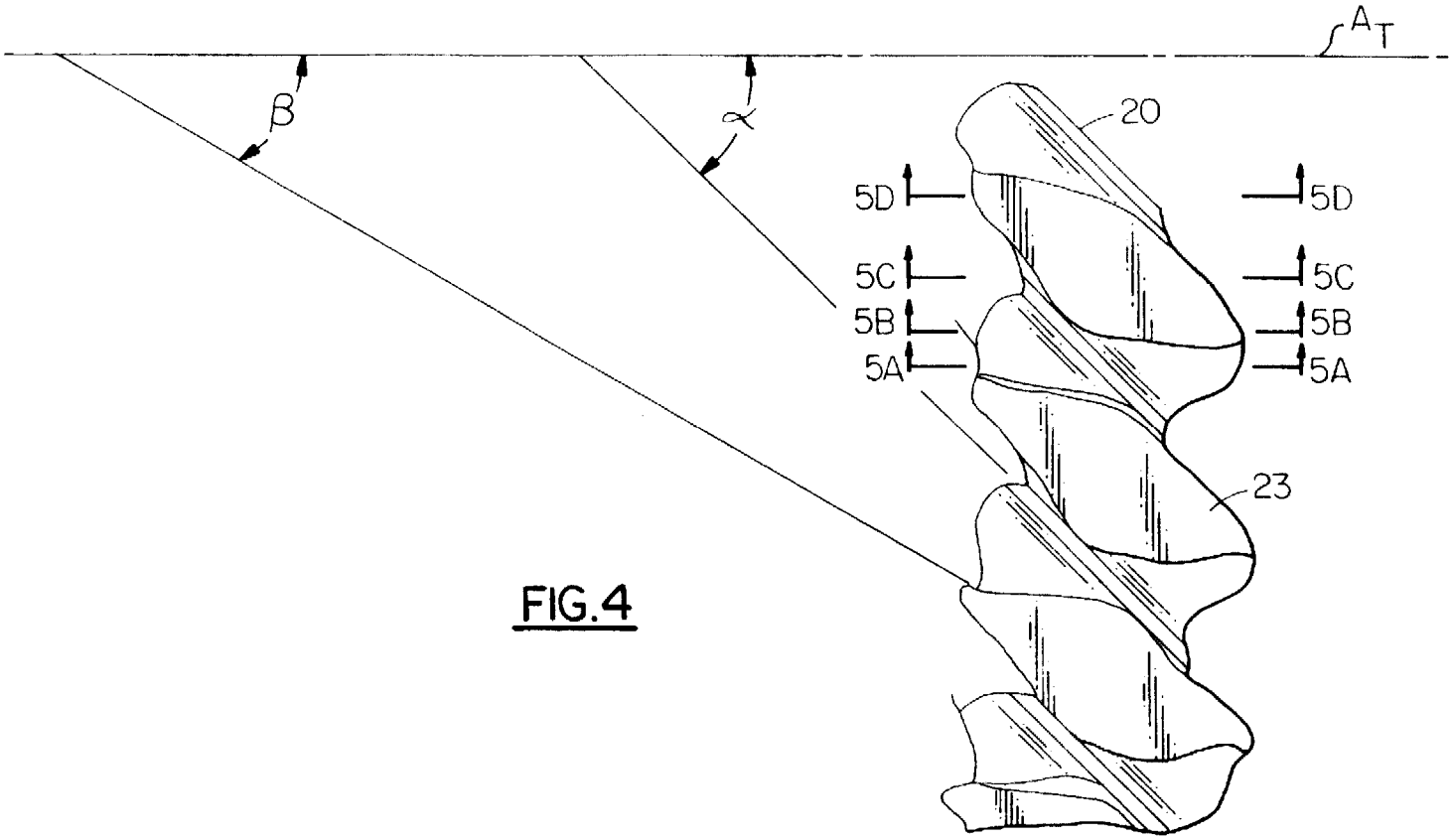
FIG. 4 is a highly magnified plan view of a portion a single helical fin or fin convolution of the tube of the present invention.

FIG. 4 is a plan view of a portion of a single fin convolution of the tube of the present invention. The angle of inclination of notch base 31 from the longitudinal axis of the tube $A_T$ is designated as $\alpha$. The angle of inclination of fin distal tip 23 from the longitudinal axis of the tube $A_T$ is designated as $\beta$, and is the angle formed between the tip axis L and the axis $A_T$. During manufacture of the tube (see FIG. 2), the interaction between rotating and advancing tube 10, notching wheel 66 and smooth wheel 67, causes the fin spike 22 to twist slightly from its base 31 to its tip 23 such that the angular orientation $\beta$ of the tip is oblique with respect to angle $\alpha$, i.e., $\beta \neq \alpha$. ($\beta$ is hereinafter referred to as the tip axis angle.)

Figure 5:
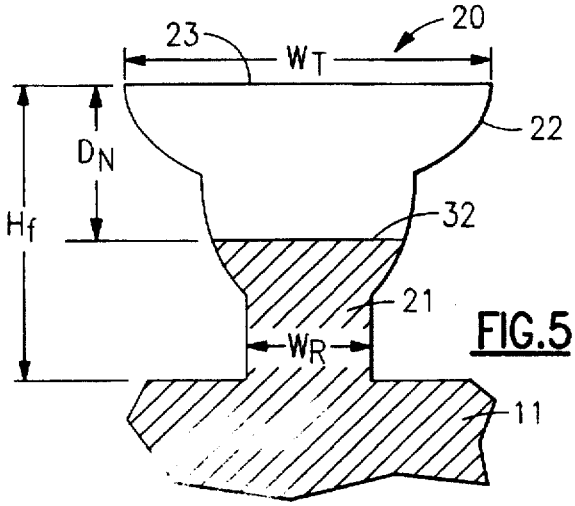
FIG. 5 is a pseudo sectioned view of a highly magnified single fin convolution of the tube of the present invention.
Figure 5A:
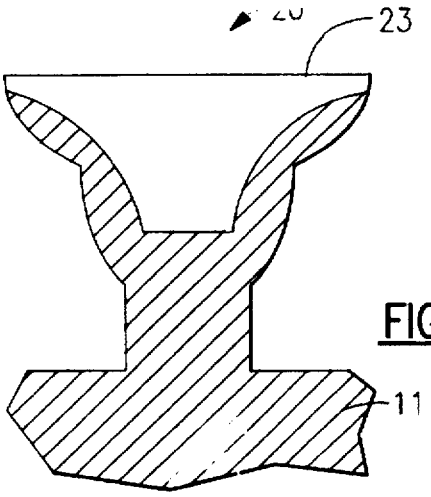
FIGS. 5A, 5B, 5C and 5D are illustrative sectioned views taken, respectively, along lines 5A—5A, 5B—5B, 5C—5C and 5D—5D in FIG. 4, of a single fin convolution of the tube of the present invention.
Figure 5B:
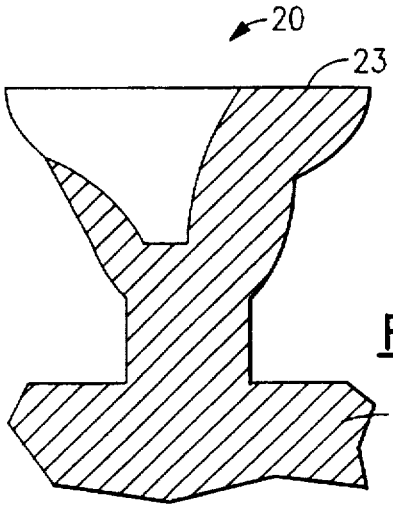
Figure 5C:
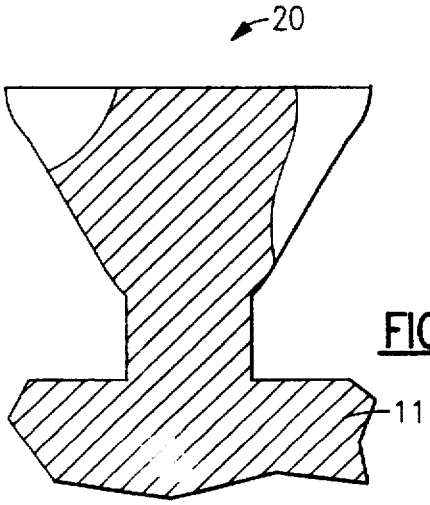
Figure 5D:
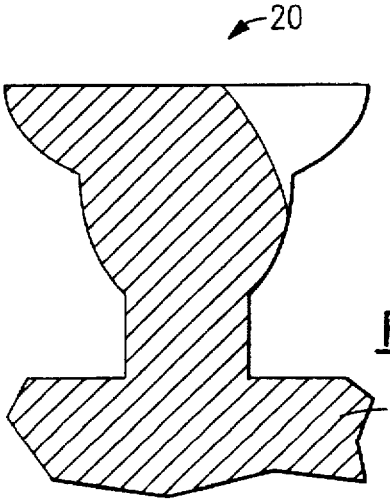

FIG. 5 is a pseudo sectioned elevation view of a single notched helical fin convolution of the tube of the present invention. The term pseudo is used because it is unlikely that a section taken through any part of the fin convolution would look exactly as the section depicted in FIG. 5. The figure, however, serves to illustrate many of the features of the tube. Fin convolution 20 extends outward from tube wall 11. The overall height of the fin convolution 20 is $H_f$. Through each fin convolution at regular circumferential intervals are notches 30, each having a notch base 31. The spikes 22 extend radially outwardly beyond the notch base 31. The width of base portion 21 is $W_r$ and the width of spike 22 at its widest dimension (in the direction of the tip axis L) is $W_t$. The outer extremity of spike 22 is the tip 23. The distance that a notch penetrates into the fin convolution is the notch depth $D_n$. Notching wheel 66 (FIG. 2) does not cut notches out of the fin convolutions during the manufacturing process but rather impresses notches into the fin convolutions. The excess material from the notched portion of the fin convolution moves both into the region between adjacent notches and outwardly from both sides of the fin convolution as well as toward tube wall 11 on the sides of the fin convolution. As a result, $W_t$ is significantly greater than $W_r$. The axial spacing between adjacent fins, the width $W_r$, the notch depth $D_n$, the number of notches per unit circumference, the angle $\alpha$ and the extent to which the fins are compressed in the radial direction by the smooth wheel 67 (FIG. 2) are selected such that the tips 23 of spikes in axially adjacent fins overlap one another (i.e. the width of the tips 23 in the direction of the tube axis $A_T$ is greater than $P_f$) and often contact each other to form reentrant cavities between adjacent fins and under the overlapping tips.

FIGS. 5A, 5B, 5C and 5D show more accurately the configuration of notched fin convolution 20 at various points as compared to the pseudo view of FIG. 5. The features of the notched fin convolution discussed above in connection with FIG. 5 apply equally to the illustrations in FIGS. 5A, 5B, 5C and 5D.

We have tested a prototype tube made according to the teaching of the present invention. That tube has a nominal outer diameter ($D_o$) of 1.9 centimeters (¾ inch), a fin height of 0.61 ($H_f$) millimeters (0.0241 inches), a fin density of 22 fins per centimeter (56 fins per inch) of tube length, 122 notches per circumferential fin, the axis of the notches being at an angle of inclination ($\alpha$) from the tube longitudinal axis ($A_T$) of 45 degrees and a notch depth of 0.20 millimeter (0.008 inch). The tested tube had three fin convolutions, or, as is the term in the art, three "starts."

Based upon extrapolation from test data, tubes according to the present invention will have nominal outer diameters of from 12.5 millimeters (½inch) to 25 millimeters (1 inch) and:

a) 13 to 28 fins per centimeter (33 to 70 fin convolutions per inch) of tube length, i.e. the fin pitch is 0.36 to 0.84 millimeter (0.014 to 0.033 inch), or
$0.36 \text{ mm} \leq P_f \leq 0.84 \text{ mm}$ ($0.014 \text{ inch} \leq P_f \leq 0.033 \text{ inch}$);

b) a ratio of fin height to tube outer diameter between 0.02 and 0.05, or $$0.02 \leq H_f/D_o \leq 0.05;$$

c) a density of 17 to 32 notches per centimeter of fin length (42 to 81 notches per inch);

d) an angle $\alpha$ between the notch axis and the tube longitudinal axis is between 40 and 70 degrees, or $$40° \leq \alpha \leq 70°; \text{ and}$$

e) a notch depth between 0.2 and 0.8 of the fin height or $$0.2 \leq D_n/H_f \leq 0.8.$$

The optimum number of fin convolutions or fin "starts" depends more on considerations of ease of manufacture rather than the effect of that number on heat transfer performance. A higher number of starts increases the rate at which the fin convolutions can be formed on the tube surface but increases the stress on the finning tools.

We claim:

1. A method for making an evaporator heat transfer tube (10) having a tube wall (11) and an outer surface (13) comprising:

a first step of forming a plurality of adjacent, radially outwardly extending helical fins (20) in the outer surface by the interaction of a finning disk (63) and a mandrel (64), whereby circumferential grooves are formed between adjacent fins;

a second step of impressing notches (30) radially into and through said fins at intervals about the circumference of the tube using a notching wheel (66), each of said notches having a base axis that is at an oblique angle with respect to both the longitudinal axis ($A_T$) of the tube and the axis of the helical fin; and a third step of Radially compressing the fins, whereby the action of impressing the notches followed by compressing the fins cause displacement of the fin material whereby fin spikes (22) with flattened distal tips (23), are formed between circumferentially adjacent notches, the spikes having tips wider than their respective bases, the tips of spikes of axially adjacent fins being twisted by the actions of the second and third steps into overlapping contacting relationship to form nucleation sites in the grooves between adjacent fins.

* * * * *